US007850444B2

(12) United States Patent
Kubicek et al.

(10) Patent No.: US 7,850,444 B2
(45) Date of Patent: Dec. 14, 2010

(54) FUEL ELEMENT FOR MELTING PLATE CANDLE ASSEMBLY

(75) Inventors: Chris A. Kubicek, East Troy, WI (US); Thomas J. Szymczak, Franksville, WI (US); Kara L. Lakatos, Racine, WI (US); Padma Prabodh Varanasi, Racine, WI (US); Joel E. Adair, Racine, WI (US); Paul E. Furner, Racine, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 328 days.

(21) Appl. No.: 12/229,257

(22) Filed: Aug. 21, 2008

(65) Prior Publication Data

US 2008/0318176 A1 Dec. 25, 2008

Related U.S. Application Data

(62) Division of application No. 11/197,839, filed on Aug. 5, 2005, now Pat. No. 7,731,492.

(51) Int. Cl.
*F23J 7/00* (2006.01)

(52) U.S. Cl. ..... 431/4; 431/289; 431/298

(58) Field of Classification Search ..... 431/4, 431/325, 298, 291, 289, 288
See application file for complete search history.

(56) References Cited

U.S. PATENT DOCUMENTS

| | | | |
|---|---|---|---|
| 213,184 | A | 3/1879 | Frick |
| 484,210 | A | 10/1892 | Ludde |
| 779,644 | A | 1/1905 | Ferrier |
| D43,845 | S | 4/1913 | Hirschfield |
| 1,195,657 | A | 8/1916 | Chersky |
| 1,229,140 | A | 6/1917 | Ritter |
| 1,320,109 | A | 10/1919 | Wooster |
| D80,971 | S | 4/1930 | Sakier |
| D110,902 | S | 8/1938 | Loesch |
| 2,234,903 | A | 3/1941 | Muench |
| 2,324,753 | A | 7/1943 | Alexiade |

(Continued)

FOREIGN PATENT DOCUMENTS

| | | |
|---|---|---|
| CA | 2208145 | 12/1998 |

(Continued)

OTHER PUBLICATIONS

International Candle House catalog (1966-67); Bobeshes pp. 54-55.

(Continued)

*Primary Examiner*—Alfred Basichas

(57) ABSTRACT

A fuel charge for use with a melting plate candle assembly includes an outer shell of fuel material surrounding an inner core of fuel material having different properties than the fuel material of the outer shell. The outer shell is substantially solid and may contain fuel additive that slows capillary flow of liquid fuel to the flame through the wick. The inner core may include liquid fuel, discrete solid fuel particles, or a solid fuel mass. The fuel additive is disposed in the fuel charge so as to slow migration of liquefied fuel to a flame on a wick only after a substantial portion of the fuel charge has been liquefied by heat from the flame.

20 Claims, 3 Drawing Sheets

U.S. PATENT DOCUMENTS

| | | | |
|---|---|---|---|
| 2,462,440 | A | 2/1949 | Tierney |
| 2,481,019 | A | 9/1949 | Joyce |
| 2,809,512 | A | 10/1957 | Harntett |
| 3,121,316 | A | 2/1964 | Wilson |
| D208,097 | S | 7/1967 | Henn |
| 3,565,281 | A | 2/1971 | Collie |
| 3,730,674 | A | 5/1973 | Gross |
| 3,741,711 | A | 6/1973 | Bryant |
| 3,797,990 | A | 3/1974 | Rogers et al. |
| 3,898,039 | A | 8/1975 | Lin |
| 3,910,753 | A | 10/1975 | Lee |
| 4,013,397 | A | 3/1977 | Neugart |
| 4,019,856 | A | 4/1977 | Lacroix |
| 4,185,953 | A | 1/1980 | Schirneker |
| 4,206,500 | A | 6/1980 | Neil |
| 4,224,017 | A | 9/1980 | Kayne |
| 4,332,548 | A | 6/1982 | Linton et al. |
| 4,381,914 | A | 5/1983 | Ferguson |
| 4,427,366 | A | 1/1984 | Moore |
| 4,477,249 | A | 10/1984 | Ruzek et al. |
| 4,557,687 | A | 12/1985 | Schirneker |
| 4,568,270 | A | 2/1986 | Marcus et al. |
| 4,755,135 | A | 7/1988 | Kwok |
| 4,917,597 | A | 4/1990 | Henze |
| 4,983,119 | A | 1/1991 | Lin |
| 5,069,617 | A | 12/1991 | Lin |
| 5,078,591 | A | 1/1992 | Despres |
| 5,193,995 | A | 3/1993 | Shirneker |
| 5,338,187 | A | 8/1994 | Elharar |
| 5,425,633 | A | 6/1995 | Cole |
| D371,212 | S | 6/1996 | Hardy et al. |
| 5,690,484 | A | 11/1997 | Leonard et al. |
| D394,513 | S | 5/1998 | Davis |
| 5,797,739 | A | 8/1998 | Lioi |
| 5,840,246 | A | 11/1998 | Hammons et al. |
| 5,842,850 | A | 12/1998 | Pappas |
| 5,843,194 | A | 12/1998 | Spaulding |
| 5,871,553 | A | 2/1999 | Spaulding |
| 5,955,034 | A | 9/1999 | Zaunbrecher et al. |
| 5,961,967 | A | 10/1999 | Powell et al. |
| 5,980,241 | A | 11/1999 | Schirneker |
| 6,019,804 | A | 2/2000 | Requejo et al. |
| 6,033,209 | A | 3/2000 | Shin et al. |
| 6,033,210 | A | 3/2000 | Freeman |
| 6,059,564 | A | 5/2000 | Morris |
| 6,062,847 | A | 5/2000 | Pappas |
| 6,068,472 | A | 5/2000 | Freeman et al. |
| 6,079,975 | A | 6/2000 | Conover |
| 6,099,877 | A | 8/2000 | Schuppan |
| 6,129,771 | A | 10/2000 | Ficke et al. |
| 6,152,728 | A | 11/2000 | Griffel |
| 6,171,102 | B1 | 1/2001 | Freeman et al. |
| 6,203,313 | B1 | 3/2001 | Holmes et al. |
| 6,214,063 | B1 | 4/2001 | DeStefano et al. |
| 6,241,512 | B1 | 6/2001 | Freeman et al. |
| 6,241,513 | B1 | 6/2001 | Jeneral |
| 6,267,584 | B1 | 7/2001 | Zou |
| 6,270,339 | B1 | 8/2001 | Zou |
| 6,276,925 | B1 | 8/2001 | Varga |
| 6,290,489 | B1 | 9/2001 | Seidler |
| 6,296,477 | B1 | 10/2001 | Lin |
| 6,299,435 | B1 | 10/2001 | Freeman et al. |
| 6,361,311 | B1 | 3/2002 | Smith |
| 6,631,311 | B2 | 3/2002 | Smith |
| D455,846 | S | 4/2002 | Araujo |
| 6,375,455 | B2 | 4/2002 | Frandsen et al. |
| D459,498 | S | 6/2002 | Araujo |
| 6,398,544 | B2 | 6/2002 | Wright et al. |
| 6,428,311 | B1 | 8/2002 | Bernardo |
| 6,435,694 | B1 | 8/2002 | Bell et al. |
| 6,439,880 | B1 | 8/2002 | Ray |
| 6,454,561 | B1 | 9/2002 | Colthar et al. |
| 6,468,071 | B2 | 10/2002 | Zoy |
| 6,491,516 | B1 | 12/2002 | Tal et al. |
| 6,533,828 | B1 | 3/2003 | Calzada |
| 6,543,268 | B2 | 4/2003 | Wright et al. |
| 6,544,302 | B2 | 4/2003 | Berger et al. |
| 6,544,303 | B2 | 4/2003 | Calzada |
| 6,551,365 | B2 | 4/2003 | Berger et al. |
| 6,568,934 | B1 | 5/2003 | Butler |
| 6,592,637 | B2 | 7/2003 | McGee et al. |
| 6,630,110 | B2 | 10/2003 | Urfig |
| 6,648,631 | B2 | 11/2003 | Wright et al. |
| 6,706,081 | B2 | 3/2004 | Mack et al. |
| 6,730,137 | B2 | 5/2004 | Pesu et al. |
| 6,733,279 | B2 | 5/2004 | Thigpen et al. |
| 6,769,905 | B2 | 8/2004 | Gray et al. |
| 6,780,382 | B2 | 8/2004 | Furner |
| 6,802,707 | B2 | 8/2004 | Furner |
| 6,849,240 | B2 | 2/2005 | Nakatsu et al. |
| 6,863,525 | B2 | 3/2005 | Byrd |
| 6,923,639 | B2 | 8/2005 | Pesu et al. |
| 7,086,752 | B1 | 8/2006 | Feuer |
| 7,229,280 | B2 | 6/2007 | Kubicek et al. |
| 7,247,017 | B2 | 7/2007 | Furner |
| 7,291,187 | B2 | 11/2007 | Welch et al. |
| 7,731,492 | B2 * | 6/2010 | Kubicek et al. ..... 431/325 |
| 2001/0031438 | A1 | 10/2001 | Hannington et al. |
| 2002/0093834 | A1 | 7/2002 | Yu |
| 2002/0102187 | A1 | 8/2002 | Bellenger et al. |
| 2002/0127507 | A1 | 9/2002 | Long |
| 2003/0064336 | A1 | 4/2003 | Welch |
| 2003/0104330 | A1 | 6/2003 | Joyner |
| 2003/0134246 | A1 | 7/2003 | Gray et al. |
| 2003/0162142 | A1 | 8/2003 | Bennetts et al. |
| 2004/0009447 | A1 | 1/2004 | Decker |
| 2004/0028551 | A1 | 2/2004 | Kvietok |
| 2004/0029061 | A1 | 2/2004 | Dibnah et al. |
| 2004/0033463 | A1 | 2/2004 | Pesu et al. |
| 2004/0128879 | A1 | 7/2004 | Lu |
| 2004/0160764 | A1 | 8/2004 | Lee |
| 2004/0229180 | A1 | 11/2004 | Furner |
| 2005/0214704 | A1 | 9/2005 | Pappas et al. |
| 2005/0227190 | A1 | 10/2005 | Pappas |
| 2006/0018786 | A1 | 1/2006 | Tolman et al. |
| 2006/0057521 | A1 | 3/2006 | Kubicek et al. |
| 2006/0057522 | A1 | 3/2006 | Kubicek et al. |
| 2006/0057523 | A1 | 3/2006 | Kubicek et al. |
| 2006/0057526 | A1 | 3/2006 | Kubicek et al. |
| 2006/0057528 | A1 | 3/2006 | Kubicek et al. |
| 2006/0057529 | A1 | 3/2006 | Kubicek et al. |
| 2006/0084021 | A1 | 4/2006 | Kubicek |
| 2006/0272199 | A1 | 12/2006 | Licciardello |

FOREIGN PATENT DOCUMENTS

| | | |
|---|---|---|
| DE | 2440068 | 3/1976 |
| DE | 2706103 | 8/1978 |
| DE | 3302591 | 8/1984 |
| DE | 3403604 | 8/1985 |
| DE | 4203644 | 8/1993 |
| DE | 4241292 | 5/1994 |
| DE | 4314122 | 11/1994 |
| DE | 4425179 | 1/1996 |
| DE | 195 08 962 | 9/1996 |
| DE | 19806404 | 9/1998 |
| DE | 102004011919 | 6/2005 |
| EP | 0018839 | 11/1980 |
| EP | 1054054 | 11/2000 |
| EP | 1564485 | 8/2005 |
| GB | 161342 | 4/1921 |
| GB | 2080514 | 2/1982 |
| JP | 6212189 | 8/1994 |
| JP | 6330082 | 11/1994 |

| | | |
|---|---|---|
| JP | 8157864 | 6/1996 |
| JP | 2003-213292 | 7/2003 |
| WO | WO 89/06141 | 7/1989 |
| WO | WO 92/08776 | 5/1992 |
| WO | WO 95/12783 | 5/1995 |
| WO | WO 01/46618 | 6/2001 |
| WO | WO 2004/008026 | 1/2004 |
| WO | WO 2004/083349 | 9/2004 |
| WO | WO 2006/031669 | 3/2006 |

OTHER PUBLICATIONS

Pourette Catalog 1998; p. 12.
Prices London Candlemakers; http:www.prices-candles.co.uk/mainpage.htm; 1 page, printed Apr. 21, 2005.
Prices London Candlemakers; http:www.prices-candles.co.uk/catalogue/Accessories/Accessories%20Page%2008.jpg; 1 page; printed Apr. 21, 2005.
Two (2) photos of Price's "Coral Bay Fragranced Bathroom" product taken Jan. 1, 1999.
Stephanie Reiser Wrought Iron—"Welcome to CourtingCandle.com!" http://www/courtingcandle.com; 1 page printed on May 12, 2004.
Intl. Search Report dated Oct. 13, 2006, Appl. No. PCT/US 2006/020218 (4315PCT).
Intl. Search Report dated Jul. 27, 2006, Appl. No. PCT/US 2005/032266 (4033 PCT).
U.S. Appl. No. 09/742,631, Office Action dated Aug. 18, 2003.
U.S. Appl. No. 09/747,525, Office Action dated Sep. 9, 2003.
U.S. Appl. No. 09/747,525, Office Action dated May 20, 2003.
U.S. Appl. No. 09/747,525, Office Action dated Jan. 10, 2003.
U.S. Appl. No. 09/747,525, Office Action dated Jul. 2, 2002.
U.S. Appl. No. 09/747,525, Office Action dated Oct. 1, 2001.
U.S. Appl. No. 10/780,028, Office Action dated Oct. 4, 2006.
U.S. Appl. No. 10/780,028, Office Action dated Apr. 11, 2006.
U.S. Appl. No. 10/780,028, Office Action dated Oct. 18, 2005.
U.S. Appl. No. 10/938,434, Office Action dated Jul. 17, 2006.
U.S. Appl. No. 10/978,744, Office Action dated Jul. 19, 2006.
U.S. Appl. No. 10/978,646, Office Action dated Aug. 3, 2006.
U.S. Appl. No. 10/978,744, Final Office Action dated Nov. 13, 2006.
U.S. Appl. No. 10/938,434, Final Office Action dated Nov. 20, 2006.
PCT Intl. Search Report and Written Opinion dated Dec. 6, 2006, Appl. No. PCT/US2006/028260.
PCT Intl. Search Report and Written Opinion dated Dec. 4, 2006, Appl. No. PCT/US2006/028222.
Intl. Search Report and Written Opinion dated Mar. 13, 2007, Appl. No. PCT/US2006/042787.
Intl. Search Report and Written Opinion dated Mar. 21, 2007, Appl. No. PCT/US2006/046057.
U.S. Appl. No. 11/123,372, Office Action dated Feb. 27, 2007.
U.S. Appl. No. 11/124,313, Office Action dated Feb. 28, 2007.
U.S. Appl. No. 11/123,461, Office Action dated Mar. 7, 2007.
U.S. Appl. No. 11/123,809, Office Action dated Mar. 7, 2007.
U.S. Appl. No. 10/978,646, Office Action dated May 4, 2007.

* cited by examiner

FUEL ELEMENT FOR MELTING PLATE CANDLE ASSEMBLY

CROSS REFERENCE TO RELATED APPLICATIONS

This application is a divisional of U.S. patent application Ser. No. 11/197,839 filed Aug. 5, 2005, now U.S. Pat. No. 7,731,492 which is incorporated by reference herein in its entirety.

REFERENCE REGARDING FEDERALLY SPONSORED RESEARCH OR DEVELOPMENT

Not applicable

SEQUENTIAL LISTING

Not applicable

BACKGROUND OF THE INVENTION

1. Field of the Invention

The present invention relates to fuel elements for candles, and more particularly to fuel elements having a plurality of distinct fuel constituents.

2. Description of the Background of the Invention

Candle fuel charges having a plurality of distinct constituents are often used to provide decorative and functional benefits. For example, some candles have a solid outer shell of a first wax surrounding a solid inner core of a second wax having a lower melting temperature than the first wax. The second wax includes a soft mixture of fragrance oil and a carrier, such as petrolatum or a low melting point wax. When a wick disposed in the inner core is burned, the first wax of the inner core is melted and burned, and the second wax of the outer shell contains the molten first wax therein. In one such candle, the solid outer shell may be refilled with replacement paraffin beads placed around a replacement wick after the original inner core wax is consumed.

Other multi-constituent candle fuel charges have gas bubbles, glass spheres, glitter, and/or other types of decorative materials entrained in a gel fuel material contained in a non-flammable container. Often the decorative materials are entrained into the gel fuel material while the gel fuel material is still molten immediately after being poured into a mold. The bubbles, glass spheres, and/or glitter are dispersed throughout and encapsulated by a substantially solid matrix of the gel fuel material after the gel fuel material cools below the melt temperature thereof. Different colorants and fragrances may be added to each layer of gel fuel material to create a multi-fragrance candle.

Yet other multi-constituent candle fuel charges have a glass vial containing fragrance oil partly embedded in a wax body parallel to and spaced from a wick. An open end of the glass vial extends upwardly from a top surface of the wax body through which the wick extends. Heat from a flame located at the wick warms the fragrance oil and disperses fragrance to the surrounding atmosphere without burning the fragrance oil.

In another multi-constituent candle, wax prill, i.e., wax pellets ranging in size between 500 microns and 2000 microns, embedded with scented volatile actives is compressed in a compression mold into a multi-layered candle. At least one layer has a different color than an adjacent layer thereto. A smooth or textured outer surface finish may be created by applying a heat source to the compression mold while the candle is being compressed or by applying an over-dip coating.

SUMMARY OF THE INVENTION

In one aspect of the invention, a fuel element for a melting plate candle assembly includes a core of meltable fuel material and a wick extending axially through the core and exposed at an end of the fuel element. An outer shell of meltable fuel material is disposed around the core, wherein the outer shell is disposed a distance from the wick sufficient to allow the outer shell to be melted when a flame is burning on the wick. An amount of fuel additive that slows capillary flow of liquid fuel to the flame through the wick is entrained in the outer shell sufficient to thicken the meltable fuel material after being melted to slow the flow of the melted fuel material along the wick to the flame, as compared to flow without the fuel additive, without preventing the melted fuel material from feeding the flame.

In another aspect of the invention, a fuel element for a melting plate candle assembly includes a core of meltable fuel material, a wick extending axially through the core and exposed at an end of the fuel element, and an outer shell of meltable fuel material disposed around the core. The outer shell is disposed a distance from the wick sufficient to allow the outer shell to be melted when a flame is burning on the wick. An amount of fuel additive that slows capillary flow of liquid fuel to the flame through the wick is sufficient to thicken the meltable fuel material after being melted to slow the flow of the melted fuel material along the wick to the flame, as compared to flow without the fuel additive, without preventing the melted fuel material from feeding the flame. The fuel additive is disposed in the fuel element at a location sufficient to slow the flow of melted fuel material along the wick only after a substantial portion of the fuel material has been melted.

Other aspects and advantages of the present invention will become apparent upon consideration of the following detailed description.

DETAILED DESCRIPTION

Figure 1:
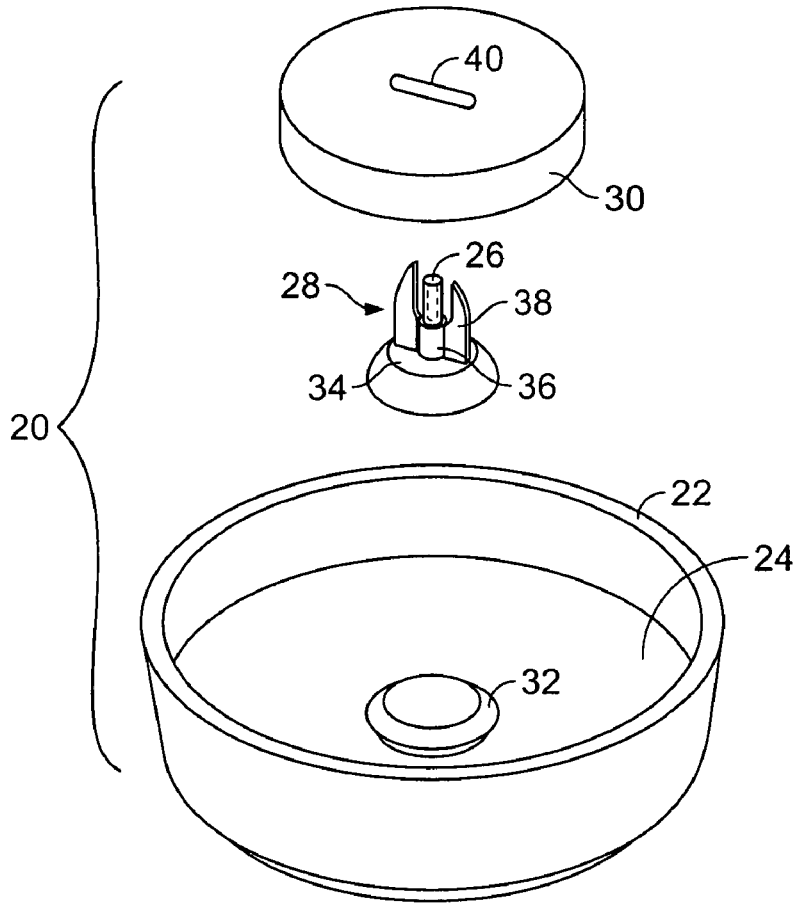
FIG. 1 is an exploded isometric view of a melting plate candle assembly having a capillary pedestal, a wick holder with fins and incorporated wick, and a fuel element according to one embodiment of the present invention.

Turning now to the drawings, a melting plate candle assembly 20 shown in FIG. 1 includes holder 22, a concave melting plate 24 carried by the holder, a wick 26 carried by a wick holder 28, and a fuel charge 30. A capillary pedestal 32 is located approximately in the center of the melting plate 24. The wick holder 28 includes a base portion 34, a wick receiver 36, such as a cylindrical tube, and a heat transmissive element, such as heat fins 38. The base portion 34 of the wick holder 28 is shaped to fit closely over the capillary pedestal 32, and may retainingly engage the capillary pedestal, such as magnetically, by snap-fit retention members, interlocking engagement members, or other suitable retention methods. The fuel charge 30 has an opening 40, such as an elongate slot, through a medial portion thereof through which the heat fins 38, wick receiver 36, and wick 26 may pass, so as to place the wick in close proximity to a top surface of the fuel element. The fuel charge 30 is shown as a wax puck, and other shapes may be used in other embodiments within the scope of the present invention.

Figure 2:
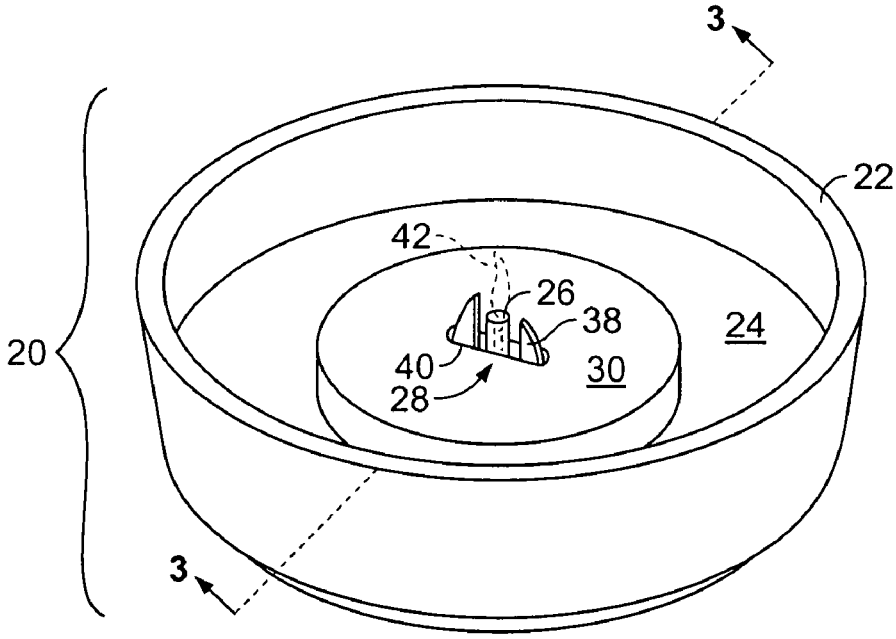
FIG. 2 is an isometric view of the melting plate, wick holder, and fuel element of FIG. 1 in an assembled, operational configuration.

In FIG. 2, the melting plate candle assembly 20 is shown in an assembled operational configuration, showing the relationship of the elements in position for lighting or ignition of the wick 26 with a flame 42. The wick holder 28 is positioned on the capillary pedestal 36 (not visible) with the heat fins 38 and wick 26 extending through the opening 40. In one embodiment, the fuel charge 30 rests directly on the melting plate 24 in the operational configuration. Additional details of a similar capillary pedestal are discussed in U.S. patent application Ser. No. 10/780,028, filed Feb. 17, 2004, which is incorporated herein by reference in its entirety, and which discloses a melting plate candle having a solid fuel element, a melting plate, and a lobe which engages a wick holder for a wick, wherein the wick holder engages the lobe in such a manner as to create a capillary flow of melted fuel from the melting plate to the wick.

When using a solid fuel material, such as candle wax, in conjunction with a heat conductive wick holder 28, solid fuel refill units similar to the fuel charge 30 may be shaped to fit a shape of the melting plate 24, with a specific relationship to the wick holder 28, which itself is engaged with the melting plate. For example, the melting plate 24 may be a decoratively shaped container, and wax may be provided in the form of fuel charge refill units specific for the container shape selected, such as round, square, oval, rectangular, triangular, or otherwise, so shaped that the wick holder assembly incorporated with the fuel element refill unit will fit and engage a complementarily shaped capillary pedestal 32. The melting plate 24 and the wick holder 28 include heat transmissive materials, such as aluminum, to transfer heat from a flame 42 on the wick 26 by conduction to the fuel charge 30, both directly through the wick holder and from the melting plate. Thereby, the fuel charge 30 is melted by heat from the flame 42 both by convection directly from the flame and by conduction through the wick holder 28 and the melting plate 24.

The use of the melting plate assembly 20 in conjunction with heat conductive elements, such as the heat fins 38, offers distinct advantages. It permits rapid formation of a pool of liquid fuel due to improved heat conduction into the fuel charge 30. This in turn allows better regulation of the size and shape, as well as the temperature, volume, and depth of the pool of liquefied fuel to allow more efficient use of fuels present. For example, melting plates 24 of the present invention permit ease of refill, with little or no cleaning. In most instances, no cleaning is required, but if desired, the melting plate 24 may be conveniently washed in a manner such as a dish, plate, or bowl is washed, in a wash basin or in a dishwasher. The use of a capillary pedestal 32 on the melting plate 24, in conjunction with heat fins 38 on the wick holder 28, also reduces or eliminates retention of solidified excess fuel when the candle is allowed to burn itself out, and permits more complete and uniform burning of fuel charges that are other than round, e.g., square, oval, triangular, or in the shape of a flower or decorative object, etc. Further, the melting plate 24, when used in conjunction with the capillary pedestal 32 and wick holder 28, provides a device that may be self extinguishing, and improves or eliminates typical burning problems encountered with standard candles, such as tunneling, drowning, collapsing, cratering, and wick drift. Fuel elements utilizing the melting plates described herein are also more forgiving of formulation or process variances. Furthermore, the presence of a magnetic retention assembly to retain the wick holder 28 on the capillary pedestal 32 provides a margin of convenience.

Figure 3A:
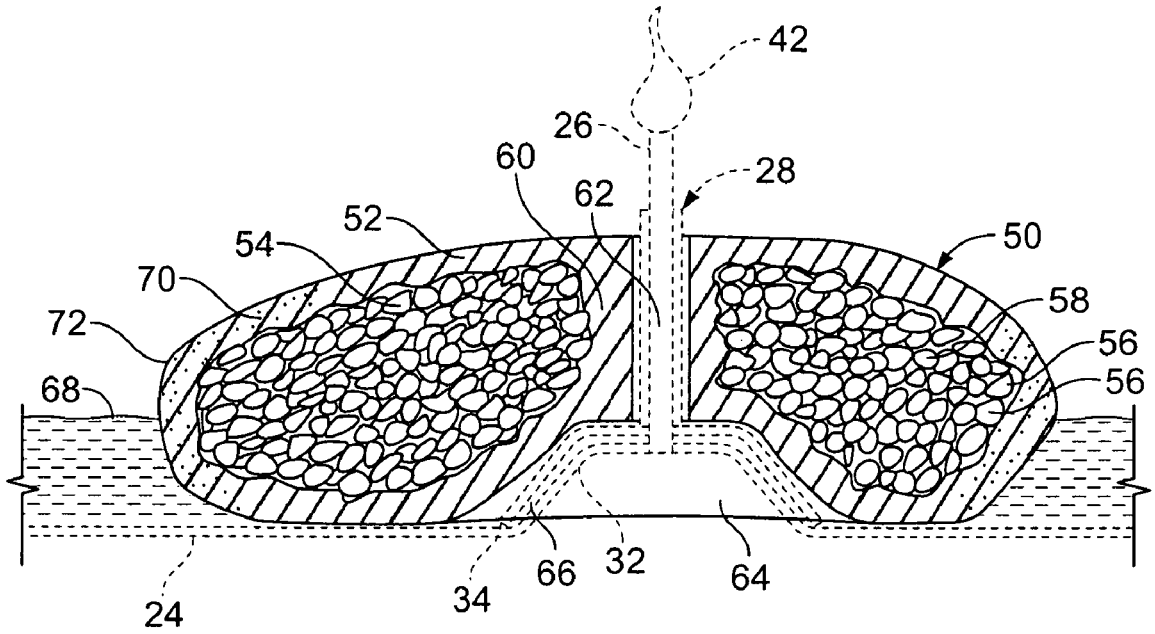
FIG. 3A is a partial cross-sectional view of a melting plate assembly as seen along the lines 3-3 of FIG. 2, but with a fuel charge according to another embodiment of the present invention.

In FIG. 3A, another embodiment of a fuel charge 50 for use with the melting plate assembly 20, includes a solid outer shell 52 and an inner core 54 that is encompassed by the outer shell. The outer shell 52 is made of a substantially solid mass of a meltable fuel material, such as pressed candle wax. The inner core 54 is made of fuel material in a different form than the meltable fuel material of the outer shell 52. In this embodiment, the inner core 54 is made substantially of closely packed discrete solid fuel particles 56, such as wax beads, having a matrix of interstitial spaces 58 extending between the wax beads. The inner core 54 may also include, or alternatively be made substantially of, fuel materials in other different form, such as, gelled fuels, liquid fuels, low melting temperature solid fuels, wax prill, and mixtures thereof, for example. The outer shell 52 may be formed by compressing a charge of the wax beads 56 in a heated press, which melts wax beads around the periphery of the charge to form the outer shell 52 as a smooth, substantially solid exterior wall. The outer shell 52 includes an inner peripheral wall portion 60, which defines an opening 62, such as an elongate slot, through a medial portion of the fuel charge 50, and a bottom cavity 64. The opening 62 and bottom cavity 64 are sized to accept a wick 26 and wick holder 28 such that the wick, wick retainer 36, and heat fins 38 extend through the opening, and the base portion 34 is disposed within the bottom cavity. As shown in broken lines, the base 34 of the wick holder 28 fits closely around a capillary pedestal 32 to form a capillary space 66 extending from near the melting plate 24 upwardly toward the wick 26 with the fuel charge 50 disposed at least partly on the melting plate. Liquid fuel, such as melted wax from the fuel charge 50, is collected on the melting plate 24 to form a pool 68 around the capillary pedestal 32. The liquid fuel travels upwardly from the pool 68 to the wick 26 through the capillary space 66 by capillary action.

A fuel additive 70 that slows capillary flow of liquid fuel to the flame through the wick and/or clogs interstitial spaces in the wick and/or breaks down wick fibers is contained within a portion of the fuel charge 50 in one embodiment of the invention. Some examples of the fuel additive 70 include a non-aqueous viscosity modifier, such as ethyl cellulose, stearamide, polyamide, hydroxypropelene cellulose, and mixtures thereof. The fuel additive 70 may also or alternatively include materials that slow capillary flow of liquid fuel to the flame, such as additives that clog interstitial spaces in the wick or that break down wick fibers. The fuel additive 70 in some embodiments may also include useful properties, such as being in the form of a dye, insect repellant, and/or fragrance. The fuel additive 70 is disposed in the fuel charge 50 such that the fuel additive is not immediately introduced into the pool 68 of liquid fuel. In this manner a flame 42 is initially provided with as much liquid fuel as possible to cause the flame to burn vigorously and melt the fuel charge 50 as quickly as possible. After the fuel additive 70 is introduced into the pool 68, migration of liquid fuel up the wick 26 is slowed (as compared to migration of the liquid fuel without the fuel additive) an amount sufficient to continue feeding the flame 42, but which decreases the size and vigorousness of the flame after a substantial amount of the fuel charge 50 has been melted. Such action in some cases may reduce the heat transfer from the flame 42 and lowers the temperature of the pool 68 after the fuel charge 50 has been substantially melted. In one embodiment, the fuel additive 70 is disposed in an outer peripheral portion 72 of the outer shell 52, which may be one of the last areas of the fuel charge 50 to be melted. In another embodiment, the fuel additive 70 may also be retained in portions of the fuel particles 56 that are disposed in the fuel charge 50 to be some of the last particles to be melted. In another embodiment (not shown), the fuel charge 50 includes two or more discrete pieces, such as vertically stacked sections, radially concentric sections, and/or partial circumferential sections, which may be assembled around the wick 26 and wick holder 28. Each discrete piece may carry a different volatile active, such as a fragrance, such that each volatile active is dispersed into the surrounding environment at different times.

In operation, the fuel charge 50 may completely melt in a shorter period of time from the flame 42 on the wick 26 than a completely solid fuel charge, such as 30, due in part to the increased surface area of the fuel particles 56 in contact with melted wax from the pool 68. More rapid melting of the fuel element 50 may allow for more rapid release of volatile actives, such as fragrances or insect repellents, entrained within at least some portions of the fuel charge. Once the fuel charge 50 is completely or almost completely melted, lowering the temperature and consumption rate of the melted fuel in the pool 68 may allow for a more sustained, longer lasting release of the volatile actives into the surrounding environment, thereby providing the benefits of the volatile active for a longer time period.

Figure 3B:
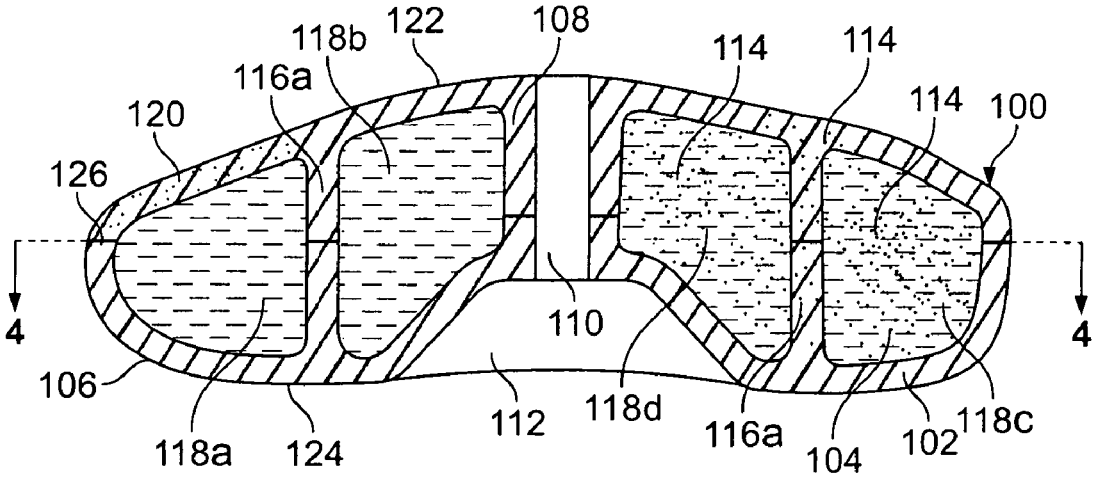
FIG. 3B is a partial cross-sectional view similar to that of FIG. 3 of a fuel charge according to yet another embodiment of the present invention.
Figure 4:
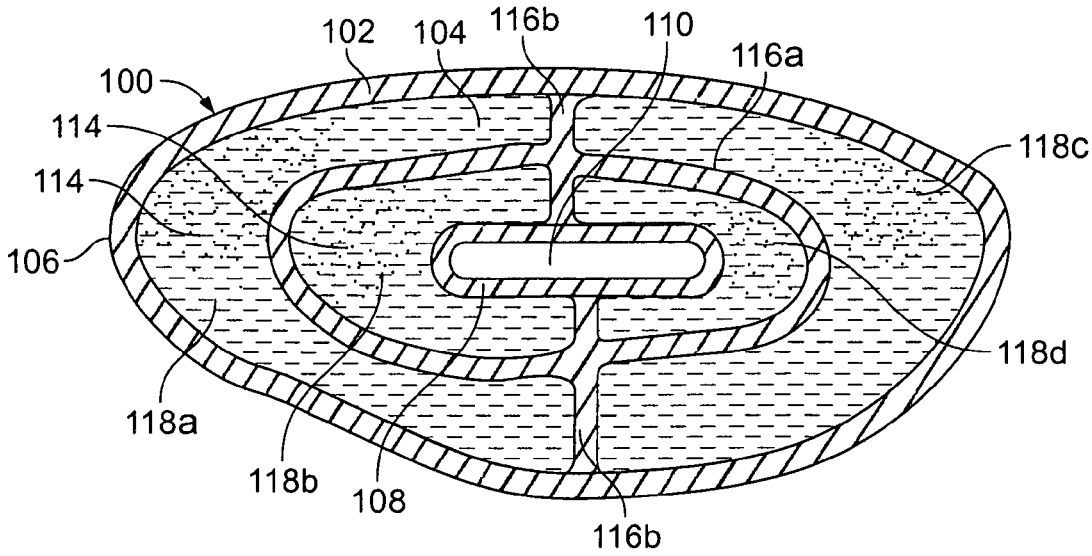
FIG. 4 is a cross-sectional view of the fuel charge as seen along the lines 4-4 of FIG. 3.

In FIGS. 3B and 4, a further embodiment of a fuel charge 100 adapted for use with a melting plate candle assembly 20 includes an outer shell 102 surrounding an inner core 104. The outer shell 102 is in the form of a substantially solid wall of meltable fuel material, such as candle wax, and the inner core 104 is in the form of a liquid fuel material, such as flammable lamp oil, for example. The outer shell 102 defines an outer peripheral wall portion 106 spaced radially outwardly from an inner peripheral wall portion 108. The inner peripheral wall portion 108 defines an opening 110 through a medial portion of the fuel charge 100 extending from a bottom cavity 112. The opening 110 in one embodiment is an elongate slot adapted to receive the wick holder 28 and wick 26 therethrough in a manner as described previously herein. One or more volatile actives 114, such as fragrances and/or insect repellents, may be dispersed in one or both of the outer shell 102 and the inner core 104. In operation with a melting plate 24, wick 26, and wick holder 28, the fuel charge 100 rapidly forms a pool of liquid fuel on the melting plate once the outer shell 102 is melted to release the liquid fuel in the inner core 104, which may allow even more rapid release of the volatile actives 114 into the surrounding environment than the fuel element 50.

The outer shell 102 in one embodiment further defines an inner medial wall 116*a* spaced between the inner peripheral wall 108 and the outer peripheral wall 106. Another medial wall 116*b* extends between the inner peripheral wall 108 and the outer peripheral wall 106. The medial walls 116*a*, 116*b* divide the inner core 104 into four compartments 118*a*, 118*b*, 118*c*, and 118*d*. In one embodiment, each compartment 118 isolated from the adjacent compartments, and each compartment is filled with a liquid fuel carrying a different volatile active 114, so that different combinations of volatile actives may be emitted into the surrounding environment as the fuel charge 100 melts to form the pool. Although four compartments 118 are shown in FIG. 4, any number—from one to many—of compartments may be formed by providing fewer or additional medial walls 116, and different combinations of volatile actives, including having the same or no volatile active throughout all the compartments of the inner core, may be formed. In another embodiment, the fuel charge 100 may be divided into discrete sections in a similar manner as described previously herein. Each discrete section of the fuel charge 100 may carry a different volatile active 114, such as a fragrance, such that a user may assemble different combinations of volatile actives around the wick 26 and wick holder 28 to provide different selected effects and/or dispense different volatile actives into the surrounding environment at different times.

In one embodiment, a fuel additive 120 that slows capillary flow of liquid fuel to the flame through the wick, such as ethyl cellulose, is disposed in a portion of the fuel charge 100 in a manner to cause the flame to burn less vigorously after a substantial portion of the fuel charge has melted as described previously herein. The fuel additive 120 may be disposed in a peripheral portion of the outer shell 102, as shown in FIGS. 3B and 4, and/or may be disposed in liquid fuel contained in an outer compartment 118.

The fuel charge 100 may be formed in one embodiment by heat pressing candle wax into two opposing portions, such as an upper portion 122 and a lower portion 124, and heat welding the opposing portions together at a seam 126. In one method, the compartments 118 of the inner core may be filled with the liquid fuel prior to heat welding the opposing portions 122 and 126 together. In another method, the compartments 118 may be filled after the opposing portions 122 and 126 are heat welded together by injecting the liquid fuel through an injection hole into the compartments and subsequently plugging the injection hole.

Figure 5:
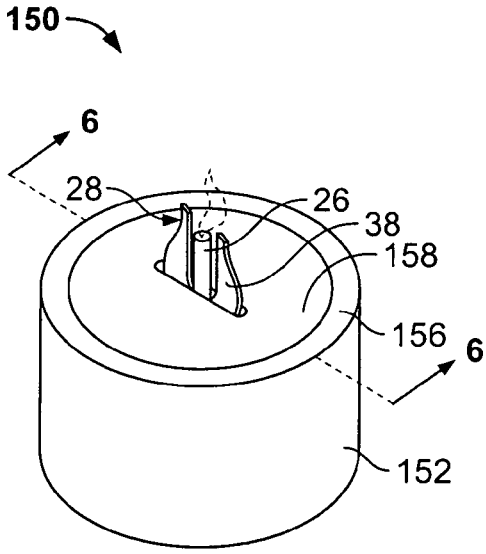
FIG. 5 is an isometric view of a fuel element according to a further embodiment of the present invention for use with the melting plate candle assembly of FIG. 1.
Figure 6:
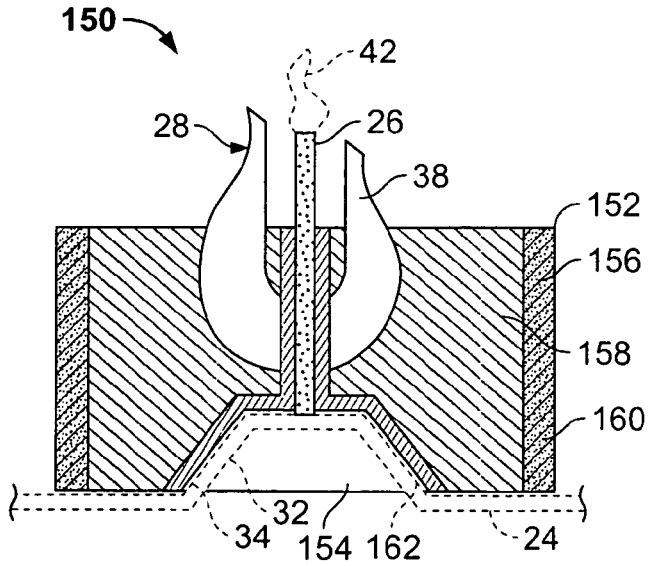
FIG. 6 is a cross-sectional view of the fuel element of FIG. 5 as seen along the lines 6-6.

In FIGS. 5 and 6, yet another embodiment of a fuel element 150 for use with a melting plate candle assembly 20 includes a wick 26 and a wick holder 28 disposed in a fuel charge 152. The wick 26 and heat fins 38 extend axially above a top end of the fuel charge 152, and a base portion 34 is disposed within a cavity 154 in a bottom end of the fuel charge. The fuel element 150 is adapted to be placed on a melting plate 24 with a capillary pedestal 32 disposed in the base portion 34 and the bottom end of the fuel charge 152 disposed on the melting plate 24 in a similar manner as described previously herein. The fuel charge 152 has an outer shell 156 of meltable fuel material, such as candle wax, surrounding an inner core 158 of meltable fuel material, which surrounds the wick 26 and the wick holder 28. Each of the outer shell 156 and the inner core 158 is a substantially solid mass at room temperature. The outer shell 156 is spaced a distance from the wick 26 sufficient to allow a flame 42 on the wick to melt the outer shell. Fuel additive 160 that slows capillary flow of liquid fuel to the flame through the wick, such as ethyl cellulose, is disposed in the outer shell 156 but not in the inner core 158. When initially lit, the flame 42 may be larger and rapidly melt the inner core 158 to form a pool of molten wax due to the free flow of melted wax to the flame through the wick 26. As the outer shell 156 is subsequently melted, the fuel additive 160 is introduced into the pool, which may slow the rate of migration of the molten wax up the wick 26 to the flame 42 and thereby decrease the size of the flame. An amount of the fuel additive 160 is disposed in the outer shell 156 that is sufficient to decrease the flame size and yet provide enough fuel flow through the wick 26 to continue feeding the flame 42.

In operation, the flame 42 melts the fuel charge 152 by direct convection and by conduction through heat transmissive surfaces such as the heat fins 38, base portion 34, and melting plate 24. The melted fuel collects into a pool of liquid fuel on the surface of the melting plate 24, and the liquefied fuel is delivered from the pool upwardly to the wick 26 by capillary action through a capillary space 162 formed between the base portion 34 and a capillary lobe 32 on the melting plate. The fuel material of the outer shell 156 introduces the fuel additive 160 into the pool after the pool has been formed, and in one embodiment, introduces an amount of the fuel additive into the pool that is sufficient to sufficient to slow migration of the liquefied fuel in the wick to the flame without extinguishing the flame only after a substantial portion of the fuel charge 152 has been melted.

The fuel charge 152 in one embodiment is substantially cylindrical, having the wick extending axially through a cylindrical inner core, which is surrounded by an adjacent outer shell. In other embodiments, the fuel charge 152 may have other shapes and may include intermediate layers and/or materials between the inner core and the outer shell and surrounding the outer shell. In yet another embodiment, the wick 26 is disposed in the fuel charge 152 without the wick holder 28 or carried by a wick holder that does not include the heat fins 38 and base portion 34, and no cavity 154 is disposed in the bottom end. In a further embodiment, the fuel charge 152 has only an axial opening through the inner core 158 adapted to accept a wick and/or wick holder therethrough. In an even further embodiment, the axial opening extends through the outer shell to allow a wick and/or wick holder to enter the axial opening from a side of the fuel charge 152.

INDUSTRIAL APPLICABILITY

The fuel charges of the present invention may be used to provide fuel to a flame on a wick portion of a melting plate candle assembly. Providing an inner core of fuel material different than a surrounding outer shell can allow the fuel charges to completely liquefy quickly, and thereby hasten emission of volatile actives that may be contained therein. Providing a fuel additive that slows capillary flow of liquid fuel to the flame through the wick in only a portion of the fuel charges can slow flow of the liquefied fuel to the flame after the fuel charge is substantially liquefied and thereby slow consumption of the liquefied fuel and increase the useful life of the fuel charge. Other useful benefits of the present invention will be apparent to those skilled in the art.

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications within the scope of the impending claims are reserved.

We claim:

1. A fuel element for a melting plate candle assembly, comprising:

a core of meltable fuel material;

a wick extending axially through the core and exposed at an end of the fuel element;

an outer shell of meltable fuel material disposed around the core, the outer shell disposed a distance from the wick sufficient to allow the outer shell to be melted when a flame is burning on the wick; and an amount of fuel additive that slows capillary flow of liquid fuel to the flame through the wick entrained in the outer shell sufficient to thicken the meltable fuel material after being melted to slow flow of the melted fuel material along the wick to the flame, as compared to flow without the fuel additive, without preventing the melted fuel material from feeding the flame.

2. The fuel element of claim 1, wherein the core is substantially cylindrical and the outer shell is disposed directly adjacent to the core.

3. The fuel element of claim 1 further comprising a heat transmissive element disposed near a location on the wick where the flame would burn and extending through a portion of the fuel element.

4. The fuel element of claim 3, wherein the heat transmissive element is exposed at a second end of the fuel element opposite the first end.

5. The fuel element of claim 1, wherein the meltable fuel materials comprise candle wax and the fuel additive comprises a non-aqueous viscosity modifier.

6. The fuel element of claim 5, wherein the non-aqueous viscosity modifier comprises ethyl cellulose.

7. The fuel element of claim 5, wherein the non-aqueous viscosity modifier comprises stearamide,

8. The fuel element of claim 5, wherein the non-aqueous viscosity modifier comprises polyamide.

9. The fuel element of claim 5, wherein the non-aqueous viscosity modifier comprises hydroxypropelene cellulose.

10. The fuel element of claim 5, wherein the non-aqueous viscosity modifier comprises a mixture of at least two components from the group consisting of ethyl cellulose, stearamide, polyamide, and hydroxypropelene cellulose.

11. The fuel charge of claim 1, wherein the fuel additive is disposed only in an outer peripheral portion of the outer shell that is one of the last areas of the fuel element to be melted.

12. A fuel element for a melting plate candle assembly, comprising:

a core of meltable fuel material;

a wick extending axially through the core and exposed at an end of the fuel element;

an outer shell of meltable fuel material disposed around the core, the outer shell disposed a distance from the wick sufficient to allow the outer shell to be melted when a flame is burning on the wick; and an amount of fuel additive that slows capillary flow of liquid fuel to the flame through the wick sufficient to thicken the meltable fuel material after being melted to slow flow of the melted fuel material along the wick to the flame, as compared to flow without the fuel additive, without preventing the melted fuel material from feeding the flame;

wherein the fuel additive is disposed in the fuel element at a location sufficient to slow the flow of melted fuel material along the wick only after a substantial portion of the fuel material has been melted.

13. The fuel element of claim 12, wherein the core is provided in a different form than the outer shell.

14. The fuel element of claim 13, wherein the core comprises closely packed discrete solid fuel particles.

15. The fuel element of claim 14, wherein the fuel additive is disposed in fuel particles that are located to be some of the last particles to be melted by a flame on the wick and not in fuel particles that are located to be some the first particles to be melted by the flame.

16. The fuel element of claim 13, wherein the outer shell further comprises an inner peripheral wall and an outer peripheral wall and forms at least one compartment within the fuel element between the inner peripheral wall and the outer peripheral wall.

17. The fuel element of claim 16, wherein the meltable fuel material of the core comprises a fuel that is liquid at room temperature contained in the compartment.

18. The fuel element of claim 17, wherein the outer shell further comprises an inner medial wall spaced between the inner peripheral wall and the outer peripheral wall, wherein the outer shell thereby forms a plurality of compartments inside the fuel element.

19. The fuel element of claim 18, wherein a first volatile active is present in one compartment and a second volatile active is present in another compartment.

20. The fuel charge of claim 12, wherein the wick is disposed in a wick holder, wherein the wick holder comprises at least one upwardly extending heat fin that is adapted to extend through a slot through the fuel element, and wherein the wick holder further comprises a downwardly turned base portion that is adapted to fit closely around a capillary pedestal to form an upwardly directed capillary space extending to a bottom end of the wick.

* * * * *